United States Patent [19]

Somiya

[11] Patent Number: 4,947,821

[45] Date of Patent: Aug. 14, 1990

[54] IGNITION SYSTEM

[75] Inventor: Masato Somiya, Anjo, Japan

[73] Assignee: Nippondenso Co., Ltd., Kariya, Japan

[21] Appl. No.: 311,292

[22] Filed: Feb. 15, 1989

[30] Foreign Application Priority Data

Feb. 18, 1988 [JP] Japan ..... 63-36358
Jul. 20, 1988 [JP] Japan ..... 63-180829

[51] Int. Cl.[5] ..... F02P 3/04

[52] U.S. Cl. ..... 123/606; 123/621; 123/644; 315/209 T; 315/223

[58] Field of Search ..... 123/606, 621, 637, 644, 123/620; 315/209 T, 223, 222, 209 M; 361/263

[56] References Cited

U.S. PATENT DOCUMENTS 2,589,164 3/1952 Tognola ..... 315/223
3,926,165 12/1975 Merrick ..... 123/637
4,149,508 4/1979 Kirk, Jr. et al. ..... 123/606
4,326,493 4/1982 Merrick ..... 123/606
4,356,807 11/1982 Tokura et al. ..... 123/606
4,381,757 5/1983 Morino et al. ..... 123/606
4,702,221 10/1987 Tokura et al. ..... 123/606

*Primary Examiner*—Andrew M. Dolinar
*Attorney, Agent, or Firm*—Cushman, Darby & Cushman

[57] ABSTRACT

An ignition system of AC continuous discharge type is disclosed which comprises a switching circuit for supplying the primary current of an ignition coil alternately in two directions and which is applicable to the internal combustion engine, for example. The rise of the primary current is slowed by an inductance device and the energy stored in the inductance device is absorbed into a capacitor.

13 Claims, 10 Drawing Sheets

IGt
0

Il
0

VL
0

Vc
0

IGt1

IGt2

I11

I12

VL1

VC1

VL2

VC2

FIG. 6
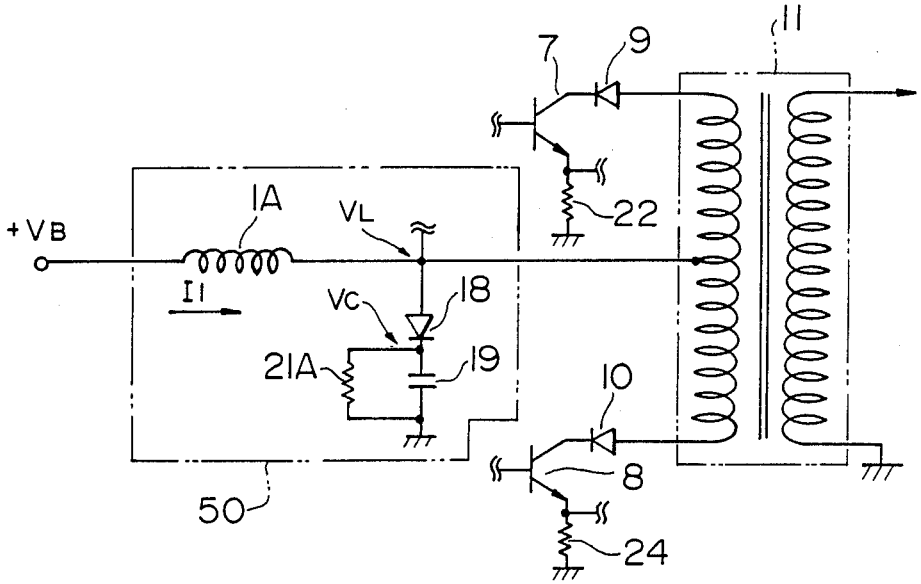
FIG. 7A
IGt
FIG. 7B
I1
FIG. 7C
VL
FIG. 7D
Vc
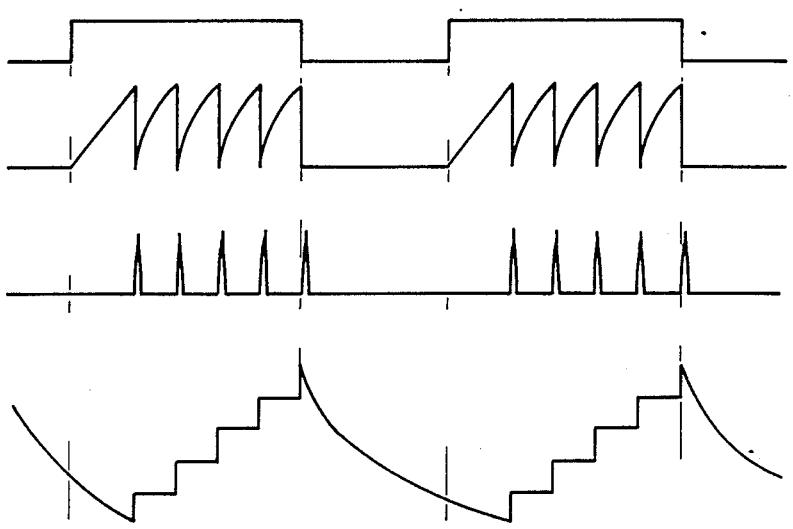

FIG. 11A
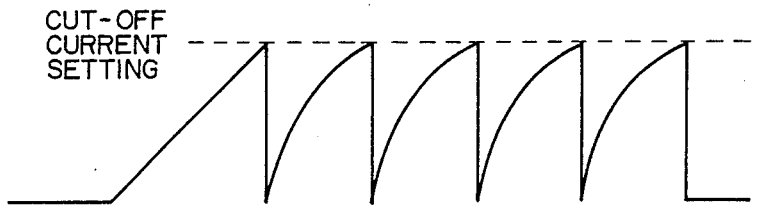
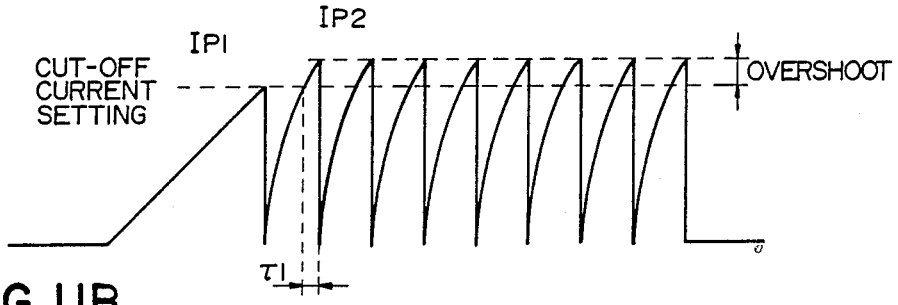
FIG. 11B
FIG. 12A
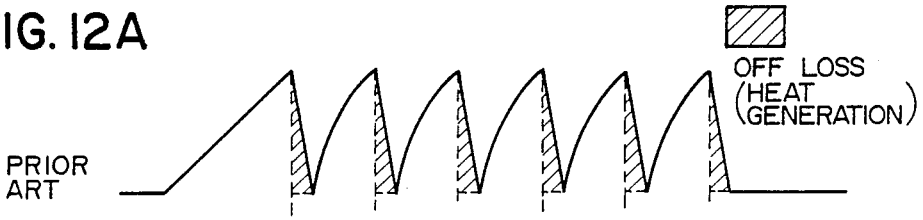
FIG. 12B
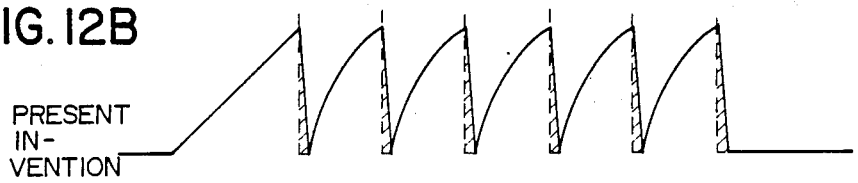

IGNITION SYSTEM

BACKGROUND OF THE INVENTION

The present invention relates to an ignition system of AC continuous discharge type used for an internal combustion engine.

In the prior art, an ignition system of AC continuous discharge type such as disclosed in JP-B-No. 62-6112 (U.S. Pat. No. 4,356,807) has been suggested in which an electric current is supplied alternately in two directions of the primary winding of the ignition coil, and by detecting this primary current, the period of current interruption is determined thereby to generate a high-frequency ignition voltage across the secondary winding of the ignition coil.

In the conventional ignition system of AC continuous discharge type which uses a couple of power transistors for turning on and off alternately the primary current of the ignition coil at high frequencies, the switching loss (off loss, in particular) of each power transistor generates a considerable amount of heat. This switching loss depends on the interruption frequency of the power transistors and the primary leakage inductance of the ignition coil. If the leakage inductance is reduced, the unit off loss of the power transistors would decrease, but the primary current would start earlier at the time of turning on of the power transistors, so that the interruption frequency of the power transistors would be for increased interruption frequencies of the power transistors. As a result, heat would be generated an increased number of times per unit time with the turning on and off of the power transistors, and the higher level of rise of the primary current would increase the overshoot of the primary current at the time of turning off of the power transistors, with the result that the cut-off current value would be increased for an increased loss of the power transistors. If the leakage inductance is increased, by contrast, in spite of the decreased on-off frequency of the power transistors, the off loss thereof would increase, thereby making it difficult to reduce the total amount of heat generation of the power transistors.

Now, the reason why the on-off frequency of the power transistors is increased by a reduced leakage inductance and the problems caused by this phenomenon will be explained in detail with reference to FIGS. 10A to 12B. FIGS. 10A to FIG. 10D show equivalent circuits of a transformer including the primary and secondary windings of the ignition coil. The equivalent circuits of FIGS. 10A to FIG. 10D are simplified to an increasing degree in that order. A basic equivalent circuit is shown in FIG. 10A. FIG. 10B shows an equivalent circuit using a coupling coefficient K of the transformer for the ignition coil. Further, FIG. 10C shows an equivalent circuit with all the circuit elements transferred to the primary circuit. In these figures, $V_b$: a source voltage, $R_1$: a primary coil resistor, $L_1$: a primary inductance, $R_2$: a secondary coil resistor, $L_2$: a secondary inductance, $I_1$: a primary coil current, $R_L$: a load resistor, N: turn ratio, $L_1'(L_1(1-k))$: a primary leakage inductance, $L_2'(L_2(1-k))$: a secondary leakage inductance. Assuming that $R_1=R_2/N^2 \div 0$ and $KL_1>>(1-k)L_1$, in FIG. 10C, on the other hand, the transformer of the ignition coil can be expressed by the simple equivalent circuit of FIG. 10D. As obvious from FIG. 10D, the rising speed of the primary coil current $I_1$ is determined by the leakage inductances $L'_1$, $L'_2$, the load resistor $R_L$ being constant. In controlling the primary coil current of the ignition system of AC continuous discharge type, when the current of a primary winding reaches a predetermined value, the same current is turned off, while the current of the other primary winding is turned on. If a coil of small leakage inductance is used for this type of ignition system, the rising speed of the primary coil current increases, so that the frequency of the primary coil current increases for an increased on-off frequency of the power transistors. This phenomenon is especially conspicuous when the source voltage $V_B$ is high.

The loss $P_0$ caused at the time of turning off the power transistors is given as $P_0=\frac{1}{2}L'_1, I_{P1}^2$, where $L_1$ is the primary leakage inductance and $I_{P1}$ the cut-off current value of the ignition coil. If the power transistors are turned off a number n of times during a predetermined discharge period, the total loss $W_0$ during the same period is given as $W_0=nP_0=\frac{1}{2}nL'\cdot I_{P1}^2$. With the increase in the rising speed of the primary coil current, that is, frequency, therefore, the on-off frequency n of the power transistors assumes a large value as shown in FIG. 11(*b*), and at the same time, due to the time delay $\tau_1$ before the current flowing in the primary winding is detected and interrupted by the power transistors, the cut-off current $I_{P1}$ increases to $I_{P2}$, with the result that the loss $W_0$, which is proportional to the square of current, sharply increases. In this way, in the case where the primary coil current rises too early, not only the frequency is increased but also an overshoot of the cut-off current is caused as shown in FIG. 11(*b*), whereby the loss is increased, thus often breaking the power transistors.

If the frequency of the primary coil current decreases, by contrast, the power transistors are turned off less rapidly as shown in FIG. 12(*a*) and are operated in an unsaturation region to a corresponding degree thereby to increase the off loss of the power transistors.

SUMMARY OF THE INVENTION

The object of the present invention is to minimize the primary leakage inductance of the ignition coil while dampening the increase in the on-off frequency of the primary current thereby to reduce the heat generation of the switching means including power transistors without deteriorating the ignition performance.

According to the present invention, there is provided an ignition system comprising an ignition coil including primary and secondary windings, first switching means for supplying current to the primary winding in one direction, second switching means for supplying current to the primary winding in the other direction, means for detecting the current flowing in the primary winding, a control circuit for turning on and off the first and second switching means alternately each time the current detected by the current detecting means reaches a predetermined level, external inductance means connected in series to the primary winding for slowing the rise of the current flowing in the primary winding when each of the switching means is turned on, and a capacitor connected to the inductance means for absorbing the energy stored in the inductance means when each of the switching means is turned on.

The ignition system according to the invention may further comprise discharge means connected to the capacitor for discharging the energy stored therein.

The inductance means further includes a transformer having the primary and secondary windings connected to the primary winding of the ignition coil, and a discharge circuit for connecting the capacitor to the secondary winding of the transformer and discharging the energy stored in the capacitor through the primary winding of the ignition coil when each of the switching means is turned on.

The discharge circuit may include energy-reducing inductance means.

The ignition system according to the invention may further comprise means for detecting the voltage generated across the secondary winding of the transformer and preventing each of the switching means from being turned on when this voltage exceeds a predetermined value.

The ignition system according to the present invention may further comprise means for generating an ignition signal in accordance with the speed of the internal combustion engine, so that the first and second switching means are turned on and off alternately by the control circuit while the ignition signal generation means generates an ignition signal.

Further, the ignition coil, the first and second switching means, the transformer, the capacitor and the discharge circuit may be provided in a plurality of sets as many as the cylinders of the internal combustion engine, and each discharge circuit is inserted between the capacitor and the ignition coil associated with the cylinder of a different set in such a manner as to discharge the energy stored in the capacitor through the primary winding of the ignition coil of the cylinder when the switching means for the same cylinder is turned on.

The ignition system according to the present invention may further comprise a couple of each of second and third diodes, so that an end of the primary winding of the transformer is extended and connected to an end of each of the primary windings of the ignition coil through each of the second diodes, while at the same time connecting the discharge circuit to an end of each of the primary windings of the ignition coils through each of the third diodes.

When the first switching means turns on, current flows in one direction through the primary winding of the ignition coil, and when this current exceeds a predetermined value, the control circuit turns off the first switching means while at the same time turning on the second switching means to cause current to flow in the other direction through the primary winding of the ignition coil. When this current exceeds a predetermined value, the second switching means is turned off by the control circuit, and at the same time the first switching means is turned on to supply the primary winding of the ignition coil with current in the other direction. By repeating this process of operation, the primary current of the ignition coil is turned on and off alternately in positive and negative directions each time the value thereof exceeds a predetermined level, thus generating a high-frequency AC voltage for ignition in the secondary winding of the ignition coil.

In view of the fact that the primary current of the ignition coil flows through the external inductance means upon turning on of each switching means, the rise of the primary current is slowed so that even if the primary leakage inductance of the ignition coil is reduced, the on-off period of each switching means is not shortened. As a result, the switching loss of each switching means can be effectively reduced to the same degree as the primary leakage inductance of the ignition coil is reduced, thereby making it possible to reduce the heat generation of the respective switching means without deteriorating the ignition performance.

Furthermore, the energy stored in the inductance means during the conduction of the switching means is absorbed into the capacitor.

The energy stored in the capacitor may also be extinguished by being discharged through discharge means connected to the capacitor. The charge voltage of the capacitor is thus prevented from being increased unnecessarily.

The inductance means mentioned above may be made up of a transformer having the secondary coil thereof connected with a capacitor which is charged with the energy stored in the transformer, and the energy thus stored in the capacitor may be released by discharge through the primary winding of the ignition coil by a discharge circuit when the switching means is next turned on, thus using the energy for ignition. This improves the ignition performance. If an energy-reducing inductance means is included in the discharge circuit, the energy stored in the capacitor is supplied slowly to the primary winding of the ignition coil, and the primary current is thus prevented from rising sharply, thereby preventing the on-off frequency of each switching means from increasing to an unnecessary degree.

The ignition system according to the invention may further comprise means for detecting the voltage generated across the secondary winding of the transformer and means for blocking the current flow through the switching means when the voltage exceeds a predetermined value. The capacitor is charged by the voltage generated across the secondary winding of the transformer before the next switching means is turned on, thereby causing the capacitor to be charged positively by the energy generated in the transformer. As a result, the energy stored in the transformer is supplied to the ignition coil before being charged into the capacitor, thus preventing the on-off frequency of the switching means from increasing to an unnecessary high level.

It is also possible to provide means for generating an ignition signal in accordance with the revolutions of the internal combustion engine, so that while this ignition signal generation means is generating an ignition signal, the first and second switching means are turned on and off alternately by a control circuit, thus generating a high-frequency AC spark voltage only during the ignition timing of the internal combustion engine. The present invention is thus applicable in satisfactory manner as an ignition system for the internal combustion engine.

By discharging the energy charged in the capacitor through the primary winding of the ignition coil of another cylinder when the switching means of the same another cylinder is turned on, on the other hand, the energy stored in the capacitor can be utilized as ignition energy for the particular cylinder, thus assuring effective use of the present invention as an ignition system of an internal combustion engine having a plurality of cylinders.

The current flowing in the primary winding of the ignition coil may also be branched through each second diode to each primary winding of each ignition coil, while the energy charged in the capacitor is supplied to each primary winding of each ignition coil through each third diode, so that each second diode may have the double functions of preventing the energy stored in the capacitor from being supplied to the primary winding of the transformer and preventing the switching means from being turned on in reverse direction. As a consequence, the number of large-capacity diodes used in the system is reduced, and hence the heat generation is proportionately decreased while at the same time improving the ignition performance.

BRIEF DESCRIPTION OF THE DRAWINGS

FIG. 6 is a circuit diagram of the essential parts of a fourth embodiment of an ignition system according to the present invention.

FIGS. 7A–7D are diagrams showing waveforms generated at various parts of the circuit shown in FIG. 6.

FIGS. 11(*a*) and 11(*b*) show waveforms for explaining the problems of the conventional ignition coil of AC continuous discharge type.

FIGS. 12(*a*) and 12(*b*) show waveforms for explaining the difference between a conventional ignition system and an ignition system according to the present invention.

DESCRIPTION OF THE PREFERRED EMBODIMENTS

Figure 1:
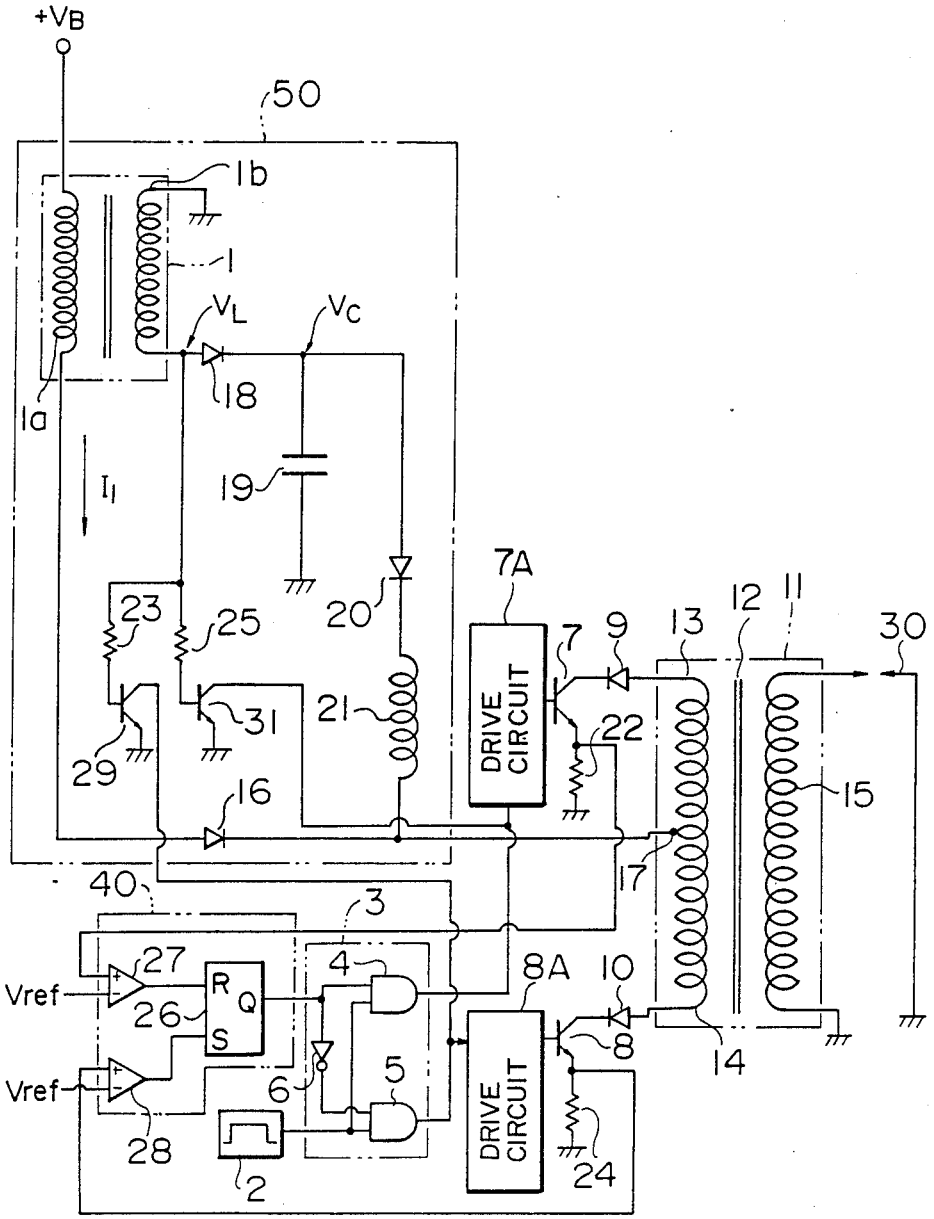
FIG. 1 is a circuit diagram showing a first embodiment of an ignition system according to the present invention.

Now, the present invention will be explained with reference embodiments shown in the accompanying drawings. In a first embodiment shown in FIG. 1, reference character $+V_B$ designates a terminal connected to the positive terminal of a car battery (not shown) providing a DC power supply, numeral 2 a signal generator for generating an ignition signal at an ignition timing in synchronism with the revolutions of an internal combustion engine not shown, and numeral 3 a logic circuit. An AND gate 4 included in the circuit 3 is a circuit for producing the logical product of an output signal of the signal generator 2 and that of a decision circuit 40 by allowing an output pulse signal of the decision circuit 40 to pass therethrough while the signal generator 2 generates an "1" signal, and producing a "0" signal always in response to a "0" signal produced by the signal generator 2. An AND gate 5 is a circuit for producing the logical product of an output signal of the signal generator 2 and an output signal of an inverter 6 for inverting the output signal of the decision circuit 40 by allowing an output pulse signal of the inverter 6 to pass therethrough while a "1" signal is generated by the signal generator 2 and producing a "0" signal always in response to a "0" signal produced by the signal generator 2. Numerals 7A, 8A designate drive circuits for amplifying outputs of the AND gates 4 and 5, numerals 7, 8 power transistors providing switching devices so connected as to turn on and off in response to outputs of the AND gates 4, 5. The base of the transistor 7 is connected through the drive circuit 7A to an output terminal of the AND gate 4, while the base of the transistor 8 is connected through the drive circuit 8A to an output terminal of the AND gate 5. The collectors of the transistors 7, 8 are connected through diodes 9, 10 to the primary windings 13, 14 respectively of an ignition coil 11, each collector being connected to the cathode of the diodes 9 and 10 respectively. The emitters of the transistors 7 and 8 are connected to the negative terminal (earth) of a DC power supply through current detection resistors 22 and 24 respectively having a very small resistance value. The ignition coil 11 includes the primary windings 13, 14 and the secondary winding 15 of 100 to 200 in turn ratio respectively and a couple of cores 12. The primary windings 13, 14 are magnetically coupled to the secondary winding 15 through the cores 12, to that the voltage generated in the primary windings 13, 14 is boosted and produced from the secondary winding 15. An end of each of the primary windings 13 and 14 is connected to the anode of the diodes 9 and 10 respectively, and an intermediate terminal 17 making up the other end thereof is connected to the positive terminal +VB of the DC power supply through an additional circuit 50. An output terminal of the secondary winding 15 is connected to a spark plug through a high-voltage cable. Also, the primary windings 13, 14 and the secondary winding 15 are wound on the central magnetic path of a couple of E-shaped cores 12 forming a closed magnetic path while being wound on a bobbin not shown. The magnetic circuit (central magnetic path) formed by the cores 12, on the other hand, has therein formed a gap of about 0.6 mm for minimizing the primary leakage inductance of the ignition coil 11 (20 $\mu$H or less or preferably about 10 $\mu$H, for example).

Further, the decision circuit 40 is for deciding on the magnitude of the primary coil current Ia, Ib of the ignition coil 11 by detecting the voltage drop across the current decision resistors 22, 24. In this decision circuit 40, the positive input terminal of a comparator 27 is impressed with the voltage drop across the current detection resistor 22 and the negative input terminal thereof with a reference voltage $V_{ref}$. As a result, the comparator 27 compares these two voltages, and when the voltage drop is larger than the reference voltage $V_{ref}$, produces a "1" signal, while producing a "0" signal if the voltage drop is smaller than the reference voltage $V_{ref}$. A comparator 28, on the other hand, has the positive input terminal thereof impressed with the voltage drop across the current detection resistor 24, and the negative input terminal thereof supplied with the reference voltage $V_{ref}$, so that when this voltage drop is larger than the reference voltage $V_{ref}$, the comparator 28 produces a "1" signal, while if the voltage drop is smaller than the reference voltage $V_{ref}$, it produces a "0" signal. The terminal S of an RS flip-flop 26 is a set input terminal, the terminal R thereof a reset input terminal, and the terminal Q thereof is an output terminal. The terminals S and R of the flip-flop 26 are connected to the output terminals of the comparators 28 and 27 respectively. When the comparator 27 produces a "1" signal, the terminal Q produces a "0" signal, while the comparator 28 produces a "1" signal, the terminal Q produces a "1" signal.

In the additional circuit 50, numeral 1 designates a transformer making up inductance means including the primary winding 1*a* and the secondary winding 1*b* having the turn ratio of 1 to 1 (with 20 turns) and the inductance of 20 to 30 μH. An end of the primary winding 1*a* is connected to the positive terminal $+V_B$ of the DC power supply and the other end thereof to the intermediate terminal 17 of the ignition coil 11 through a second diode 16. Also, an end of the secondary winding 1*b* is grounded, and the other end thereof is connected through a first diode 18 to an end of a capacitor 19 having a capacity of about 10 μF, the other end of which is grounded. Further, an end of the capacitor 19 is connected to the intermediate terminal 17 of the ignition coil 11 through the energy-reducing inductor 21 of about 60 μH in inductance (about three times the primary inductance of the transformer 1) and a third diode 20. Furthermore, the other end of the secondary winding 1*b* of the transformer 1 is connected through resistors 23 and 25 to the bases of transistors 29 and 31 respectively. The collectors of the these transistors 29 and 31 are connected to the output terminals of the AND gates 4 and 5 respectively, and the emitters thereof are grounded. The resistors 23, 25 and the transistors 29, 31 make up a blocking circuit.

Now, the operation of the circuit having the aforementioned configuration will be explained. The signal generator 2 for generating an ignition signal in synchronism with the revolutions of the internal combustion engine in its operation produces a rectangular pulse signal shown by IGt in FIG. 2A. Specifically, the signal generator 2 produces a "1" signal only during the spark discharge period. On the other hand, the decision circuit 40 produces a rectangular pulse signal of about 2 to 5 KHz in natural frequency as determined by the circuit design including the transformer 1 and the ignition coil 11 as described later. The inverter 6 produces a pulse signal inverted from this rectangular pulse signal. As a result, the AND gates 4 and 5 produce an alternately-inverted combined pulse signal while the signal generator 2 produces a "1" signal. The transistors 7 and 8 are turned on and off in accordance with the outputs of the AND gates 4 and 5 respectively, and therefore while the signal generator 2 produces a "1" signal, the bases of the transistors 7 and 8 are supplied with pulse signals of opposite phases, whereby the transistors 7 and 8 repeat on-off operations alternately.

Thus, while a "1" ignition signal is produced from the signal generator 2, a high-frequency AC voltage is generated across the secondary winding 15 of the ignition coil 11 thereby to cause an AC continuous discharge of the ignition plug 30.

Now, explanation will be made about the operation of the additional circuit 50 making up the essential parts of the present invention. The current flowing in the primary windings 13 and 14 of the ignition coil 11 while the transistors 7 and 8 are conducting also flows through the primary winding 1*a* of the transformer 1 (the current flowing in the primary winding 1*a* of the transformer 1 is designated by $I_1$ in FIG. 2B), and therefore the primary inductance thereof (20 to 30 μH) thereof retards the rise of the primary current of the ignition coil 11, with the result that the on-off frequency of the power transistors 7 and 8 is reduced, so that the leakage inductances of the primary windings 13 and 14 of the ignition coil 11 are reduced to a corresponding degree. By decreasing the primary leakage inductance of the ignition coil 11 without increasing the on-off frequency of the power transistors 7 and 8 in this manner, the switching loss of the power transistors 7 and 8 can be reduced effectively.

Figures 2A, 2B, 2C, 2D:
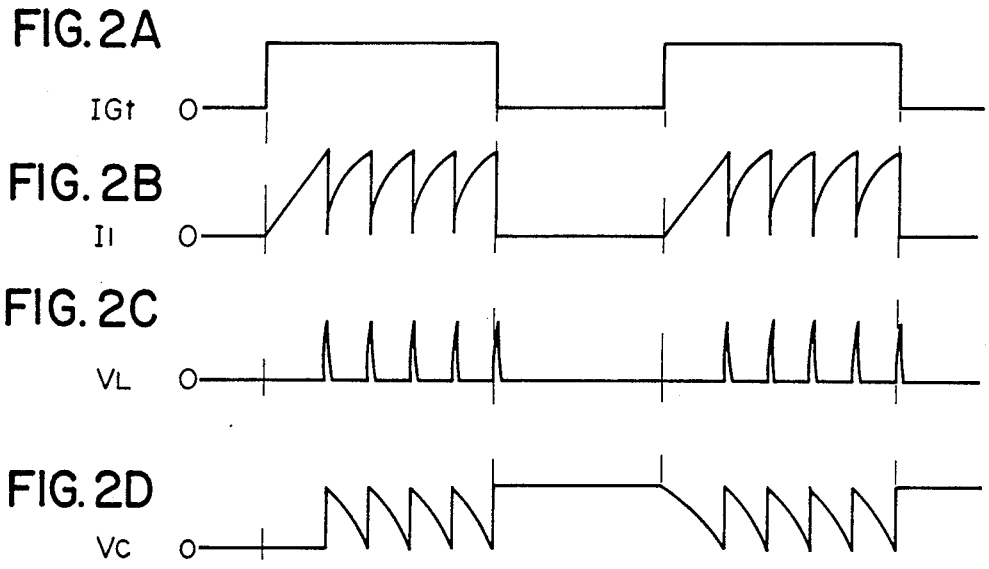
FIGS. 2A–2D show waveforms generated in various parts of the circuit shown in FIG. 1.

Due to the energy stored in the transformer 1 while the power transistors 8 and 9 are conducting, a voltage indicated by $V_L$ in FIG. 2C is generated across the secondary winding 1*b* of the transformer 1 when the power transistors 7 and 8 are turned off. This voltage is used to charge the capacitor 19 rapidly through the diode 18, and the energy stored in the transformer 1 is thus absorbed into the capacitor 19. In the process, the voltage generated across the secondary winding 1*b* of the transformer 1 causes the transistors 29 and 31 to be turned on through the resistors 23 and 25 respectively, so that the outputs of the AND gates 4 and 5 are short circuited to block the conduction of the power transistors 7 and 8 during a short period of time when the capacitor 19 is being charged by the voltage generated across the secondary winding 1*b* of the transformer 1. After the capacitor 19 is charged, on the next occasion of conduction of one of the power transistors 7 and 8, charges in the capacitor 19 are supplied slowly to the primary winding 13 or 14 associated with a conducting one of the power transistors through the diode 20 and the energy reducing inductor 21, thus increasing the ignition energy without sharp rise of the primary current of the ignition coil 11. At the same time, the voltage charged into the capacitor 19 by the energy stored in the transformer 1 by the conduction of one of the power transistors 7, 8 is discharged at the time of conduction of the other power transistor, so that the capacitor 19 is charged only with a voltage corresponding to the energy stored in the transformer 1 by a single conduction of each of the power transistors 7 and 8, thus the capacitor 19 may have a comparatively small withstanding voltage.

Figure 3:
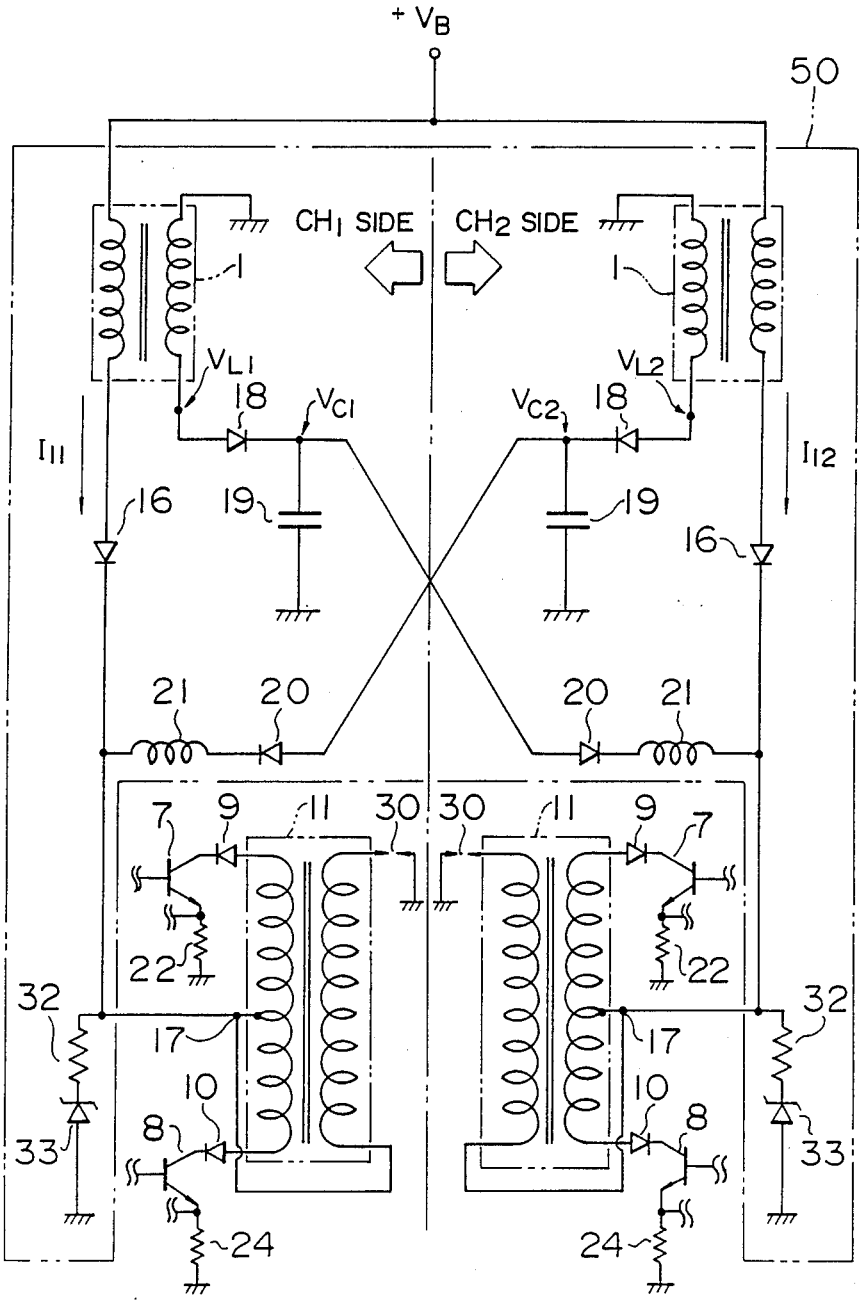
FIG. 3 is a circuit diagram showing the essential parts of a second embodiment of an ignition system according to the present invention.
Figures 4A, 4B, 4C, 4D, 4E, 4F, 4G, 4H:
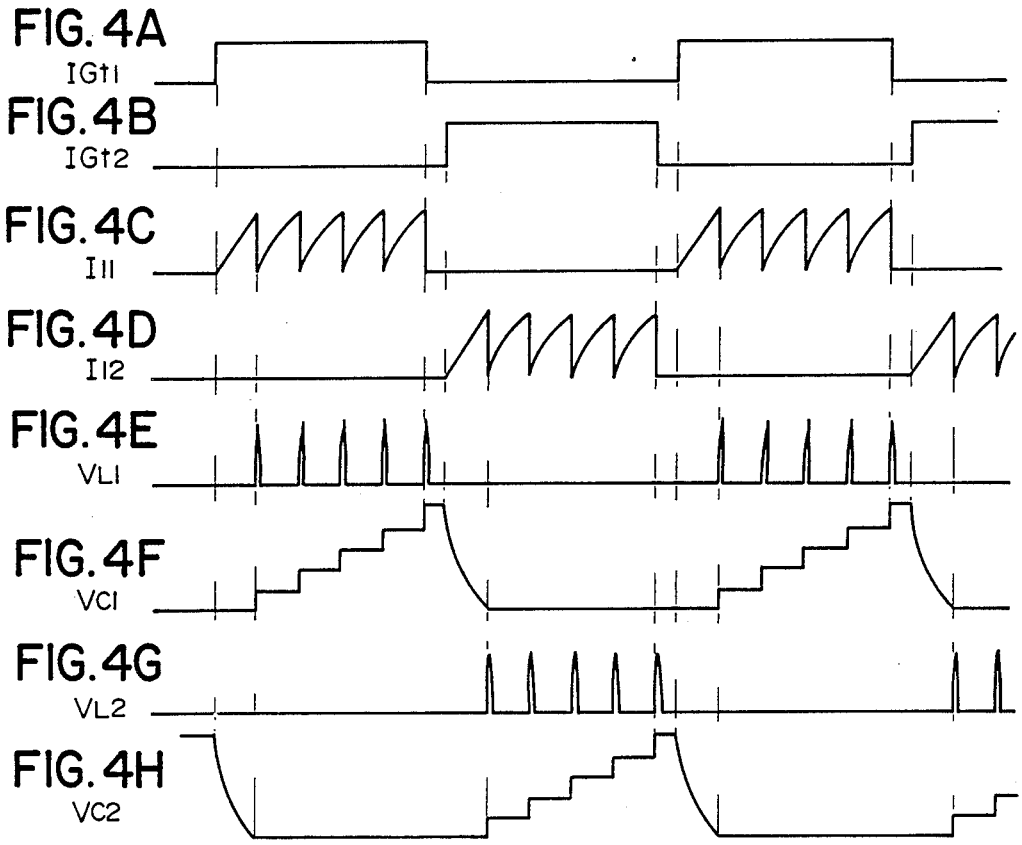
FIGS. 4A–4H show waveforms generated at various parts of the circuit shown in FIG. 3.

FIG. 3 shows a configuration of the essential parts of a second embodiment of the present invention. This embodiment, unlike the first embodiment described above, comprises a couple of each of the devices including the transformer 1, the power transistors 7, 8, ignition coil 11, the diodes 9, 10, 16, 18, 20, the capacitor 19, the energy-reducing inductor 21 and the ignition plug 30. The capacitor 19 of each set is connected to the primary winding of the ignition coil 11 of the other set through the diode 20 and the energy-reducing inductor 21 of the other set. Further, an end of the secondary winding of each ignition coil 11 is connected to the intermediate terminal 17 of the primary winding, and this intermediate terminal 17 is grounded through a resistor 32 and a zener diode 33. The configuration of the remaining parts of the circuit is identical to that of the first embodiment. According to the second embodiment, the signal generator 2 generates two ignition signals IGt1 and IGt2 alternately as shown in FIGS. 4A and 4B associated with the ignition timings of the respective sets, and supplies the transformers of the respective sets with on-off primary currents designated by $I_{11}$ and $I_{12}$ in FIGS. 4C and 4D alternately, so that on-off voltages designated by $V_{L1}$ and $V_{L2}$ of FIGS. 4E and 4G are generated alternately across the secondary winding of each transformer, thus charging the capacitors 19 of the respective sets in the manner as shown by Vc1 and Vc2 in FIGS. 4F and 4H.

In this second embodiment, the charge voltage of each capacitor 19 is not discharged until the conduction of the power transistor 7, 8 of the other set, and therefore a plurality of charges occur during a single spark discharge period as shown by Vc1 and Vc2 in FIG. 4. This requires a capacitor 19 comparatively large in withstanding voltage. Nevertheless, it is possible to eliminate the blocking means including the resistors 23, 25 and the transistors 29, 31 required in the first embodiment.

Figure 5:
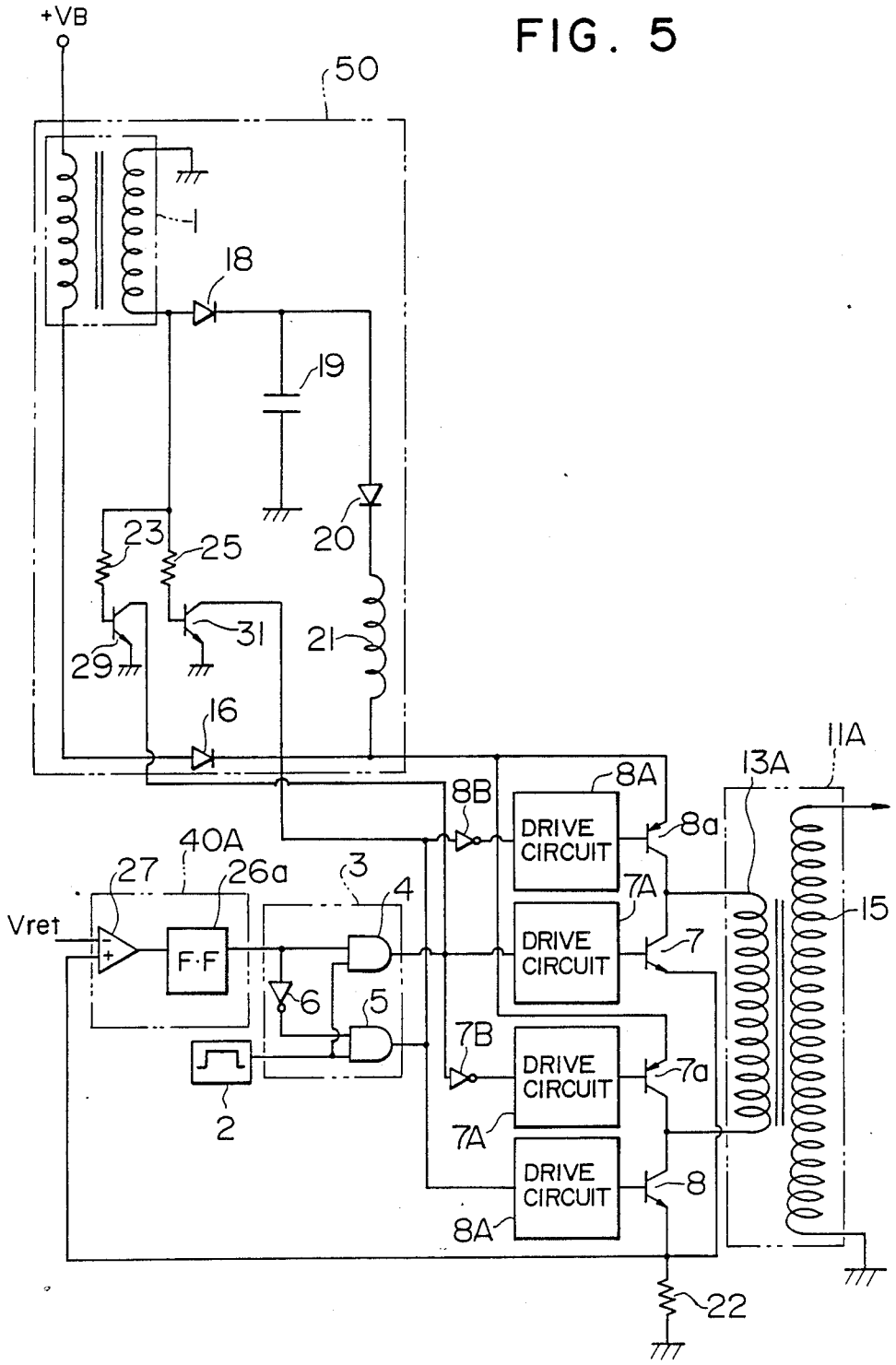
FIG. 5 is a circuit diagram showing the essential parts of a third embodiment of an ignition system according to the present invention.

FIG. 5 is a diagram showing a configuration of the essential parts of a third embodiment of the present invention. Unlike in the first embodiment, an ignition coil 11A having a single primary winding 13A is used, and the ends of this primary winding 13A are grounded through power transistors 7, 8 of NPN type and a common primary current detection resistor 22 on the one hand and connected to the positive terminal +VB of a DC power supply through power transistors 8*a*, 7*a* of PNP type and a common additional circuit 50 on the other. At the same time, the non-grounded end of the current detection resistor 22 is connected to a positive input terminal of a comparator 27, which makes up a decision circuit 40A with a flip-flop 26*a* with an output thereof adapted to be inverted each time of generation of a "1" output signal from the comparator 27. Further, the output terminals of the AND gates 4 and 5 are connected to the bases of the power transistors 7*a* and 8*a* of PNP type through inverters 7B and 8B and drive circuits 7A and 8A respectively.

According to this third embodiment, a couple of the power transistors 7*a* and 7 are turned on during a spark discharge period, so that a current flows in one direction in the single primary winding 13A of the ignition coil 11A through the additional circuit 50, and when this current exceeds a predetermined value, the output level of the comparator 27 becomes "1" thereby to invert the output of the flip-flop 26*a*, with the result that the power transistors 7*a* and 7 are turned off while the other couple of the transistors 8*a* and 8 are turned on. Thus the current in the other direction flows in the primary winding 13A of the ignition coil 11A through the additional circuit 50, and when this current exceeds a predetermined value, the output of the comparator 27 becomes "1", with the output of the flip-flop 26*a* inverted, with the result that the power transistors 8*a* and 8 are turned off while the other set of the power transistors 7*a* and 7 are turned on. This process of operation is repeated alternately. This way, as in the first embodiment described above, a high-frequency AC voltage is generated across the secondary winding 15 of the ignition coil 11 while a "1" ignition signal is being generated from the signal generator 2, thus causing an AC continuous discharge at the ignition plug 30. The additional circuit 50 operates substantially the same manner and to produce the same effect as in the first embodiment.

FIG. 6 shows a configuration of the essential parts of a fourth embodiment of the present invention. As compared with the first embodiment, this embodiment comprises the additional circuit 50 using an autoinductor 1A as an external inductance means, and a resistor 21A making up discharge means in parallel to the capacitor 19, while the diodes 16, 20 and the energy-reducing inductor 21 are eliminated. The configuration of the other parts is the same as that of the first embodiment. According to this fourth embodiment, with the generation of an ignition signal designated by IGt in FIG. 2A from the signal generator 2, the power transistors 7 and 8 are turned on alternately, so that the primary current flows in the ignition coil 11 as shown by $I_1$ in FIG. 7B through the external inductor 1A. In the process, the energy stored in the external inductor 1A generates a voltage indicated by $V_L$ in FIG. 7C across the external inductor 1*A* at the time of turning off of each of the power transistors 7 and 8, thereby charging the capacitor 19 in the manner shown by Vc in FIG. 7D. The charge voltage thus stored in the capacitor 19 is discharged through the resistor 21A while the power transistors 7 and 8 are both turned off with the ignition signal level of the signal generator 2 at "0".

Figure 8:
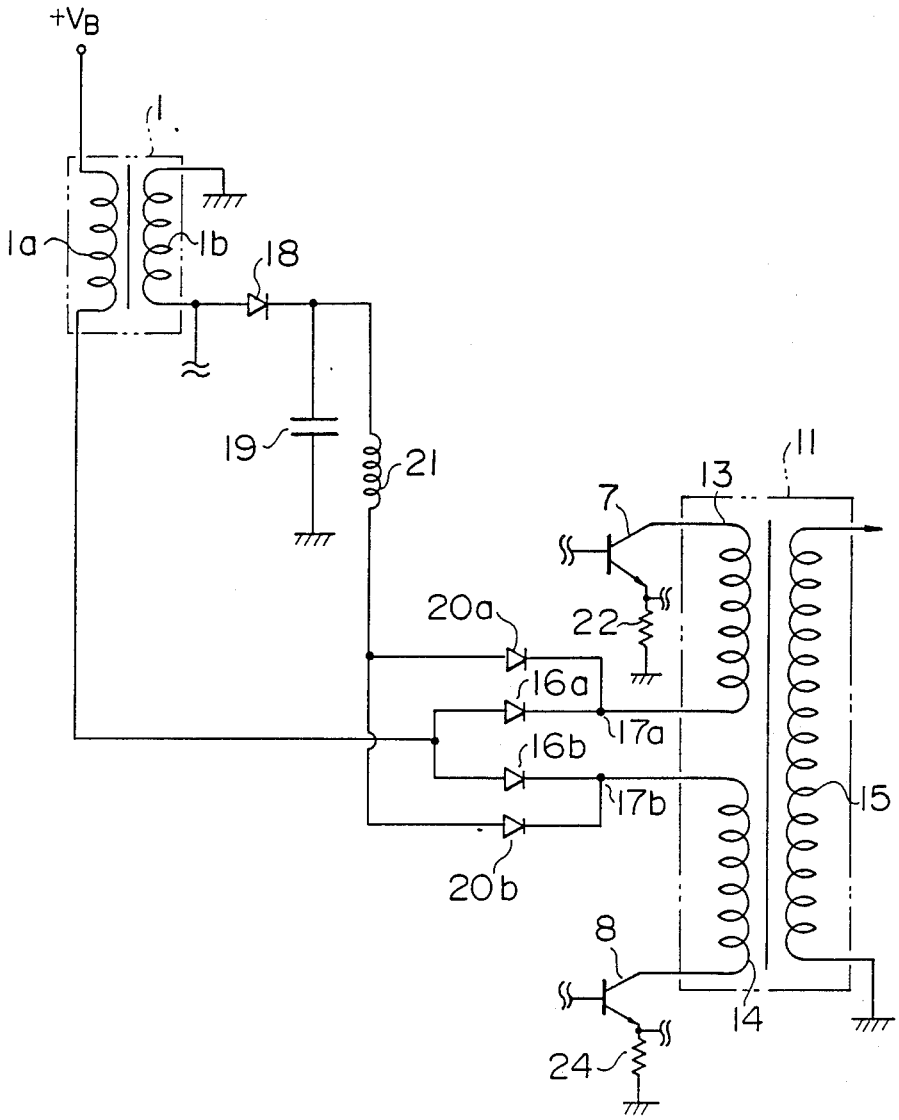
FIG. 8 is a circuit diagram showing the essential parts of a fifth embodiment of an ignition system according to the present invention.

A configuration of the essential parts of a fifth embodiment of the present invention is shown in FIG. 8. This embodiment, as compared with the first embodiment described above, comprises a couple of the second diodes 16*a*, 16*b* and a coupled of the third diodes 20*a*, 20*b*, and an end of the primary winding 1*a* of the transformer 1 is extended through the second diodes 16*a*, 16*b* and connected to the ends 17*a*, 17*b* of the primary windings 13, 14 of the ignition coil 11, respectively. Further, an end of the energy-reducing inductor 21 is extended through the third diodes 20*a*, 20*b* and connected to the ends 17*a*, 17*b* of the primary windings 13, 14 of the ignition coil 11 respectively, while doing without the diodes 9 and 10. Specifically, in the first embodiment requiring a total of three diodes including the two diodes 9 and 10 for preventing reverse conduction of the power transistors 7, 8 and the second diode 16 for preventing the energy stored in the capacitor 19 from being supplied to the primary winding 1*a* of the transformer 1, and a comparatively large current flows in each of these three diodes from the ignition coil 11, so that these diodes require a large capacity and generate a large amount of heat with the ignition performance reduced by the voltage drop thereacross. In the embodiment shown in FIG. 8, by contrast, these two functions are accomplished by the second diodes 16*a* and 16*b*, and therefore a diode of large capacity can be eliminated for lesser heat generation and improved ignition performance.

Figure 9:
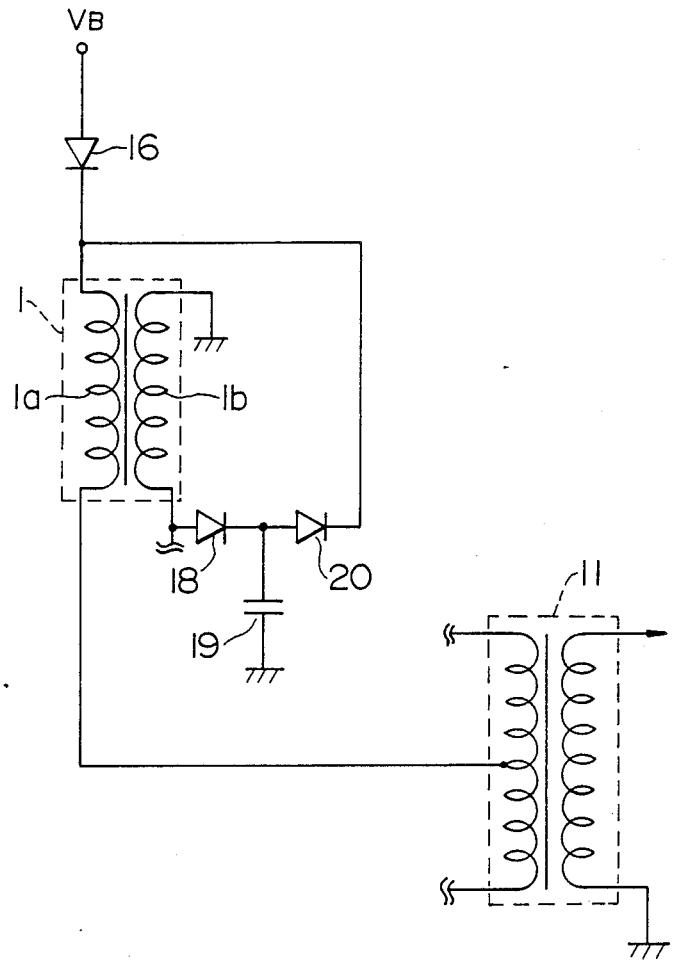
FIG. 9 is a circuit diagram showing the essential parts of a sixth embodiment of an ignition system according to the present invention.
Figure 10A:
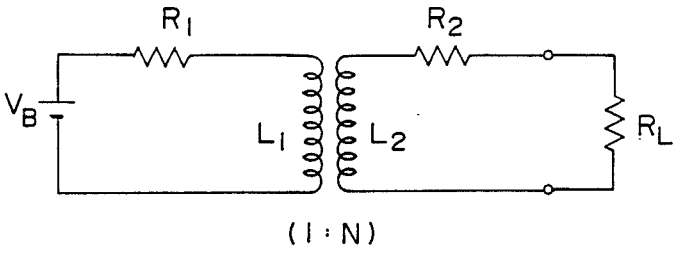
FIGS. 10A to 10D are circuit diagrams for explaining the operation of a transformer for the ignition coil.
Figure 10B:
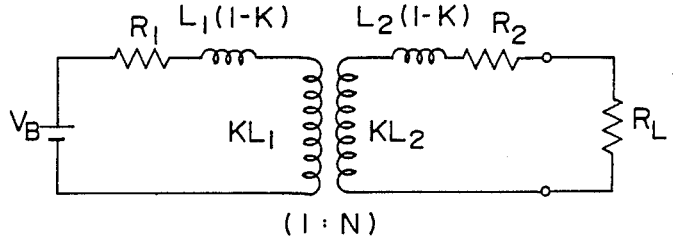
Figure 10C:
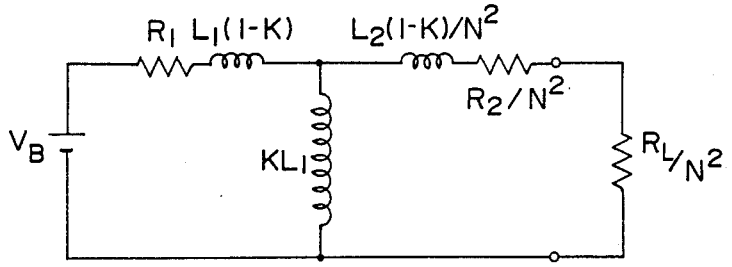
Figure 10D:
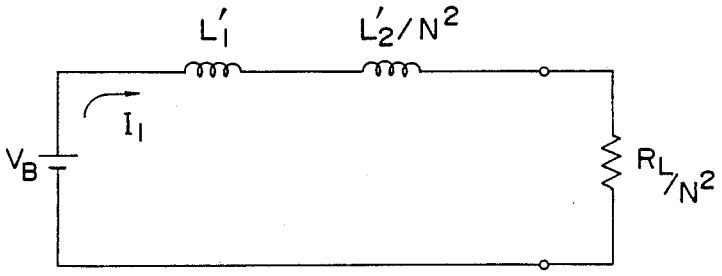

A configuration of the essential parts of a sixth embodiment of the present invention is shown in FIG. 9. In this embodiment, the energy-reducing inductor 21 is eliminated from the additional circuit 50 in the first embodiment of FIG. 1, and the diode 16 is connected to the power side of the transformer 1, while the cathode of the diode 20 is connected to the powerside terminal of the primary winding 1*a* of the transformer 1. The configuration of the other parts is identical to that of the first embodiment. This configuration requires no energy-reducing inductor, and the circuit components are thus reduced in number, thereby simplifying the construction.

Although the embodiments are explained above for applications of the invention to the ignition system of the internal combustion engine, the present invention is also applicable to the ignition system for other combustion devices such as the boiler. In such a case, the signal generator 2 is provided by a timer or a simple manual switch for generating a "1" signal only when continuous spark discharge is desired.

We claim:

1. An ignition system comprising:

an ignition coil having primary winding means and a secondary winding, first switching means for supplying current to the primary winding means in one direction, second switching means for supplying current to the primary winding means in the other direction, current detection means for detecting the current flowing in the primary winding means, a control circuit for turning on and off the first and second switching means alternately each time the current detected by the current detection means exceeds a predetermined value, external inductance means connected in series to the primary winding means of the ignition coil for slowing the rise of the current flowing in the primary winding means when each of said switching means is turned on, and a capacitor connected to said inductance means for absorbing the energy stored in the inductance means when each of said switching means is turned on.

2. An ignition system according to claim 1, further comprising discharge means connected to said capacitor for discharging the energy stored in said capacitor.

3. An ignition system according to claim 2, wherein said discharge means is a resistor.

4. An ignition system according to claim 1, wherein said inductance means includes a transformer having the primary winding means and secondary winding connected to the primary winding means of said ignition coil, said capacitor being connected to the secondary winding of said transformer, said ignition system further comprising a discharge circuit for discharging the energy stored in said capacitor through the primary winding means of said ignition coil when each of said switching means is turned on.

5. An ignition system according to claim 4, further comprising current blocking means for detecting the voltage generated across the secondary winding of said transformer and preventing the conduction of each of said switching means when said voltage exceeds a predetermined value.

6. An ignition system according to claim 4, wherein said discharge circuit includes energy-reducing inductance means.

7. An ignition system according to claim 6, further comprising current blocking means for detecting the voltage generated across the secondary winding of said transformer and preventing the conduction of each of the switching means when said voltage exceeds a predetermined value.

8. An ignition system according to claim 4, wherein said discharge circuit includes the primary winding means of said transformer as a discharge path.

9. An ignition system according to claim 8, further comprising current blocking means for detecting the voltage generated across the secondary winding of the transformer and preventing the conduction of each of the switching means when said voltage exceeds a predetermined value.

10. An ignition system comprising ignition signal generation means for generating an ignition signal in accordance with the revolutions of an internal combustion engine, an ignition coil including two primary windings and one secondary winding, first switching means for supplying current to one of said two primary windings in one direction, second switching means for supplying current to the other of said two primary windings in the other direction, current detection means for detecting the current flowing in each of said primary windings, a control circuit for generating a control signal for turning on and off said first and second switching means alternately each time the current detected by said current detection means exceeds a predetermined value while an ignition signal is generated by said ignition signal generation means, a transformer having primary and secondary windings the primary winding being connected in series to each of said primary windings of the ignition coil for slowing the rise of the current flowing in each of said primary windings of said ignition coil during the conduction of each of said switching means, a capacitor connected to the secondary winding of said transformer for absorbing the energy stored in the inductance means during a given conduction of each of said switching means, a first diode for preventing the energy stored in said capacitor from being discharged through the secondary winding of said transformer, a discharge circuit for discharging the energy stored in said capacitor through the primary winding of said ignition coil during the next conduction of each of said switching means, and a second diode for preventing the energy stored in said capacitor from being supplied to the primary winding of said transformer through said discharge circuit, said discharge circuit including a third diode and an energy-reducing inductor in series.

11. An ignition system according to claim 10, further comprising current blocking means for preventing each of said switching means from being turned on when said voltage exceeds a predetermined value.

12. An ignition system according to claim 11 comprising a plurality of sets of said ignition coil, said first and second switching means, said transformer, said capacitor, said discharge circuit and said first and second diodes in accordance with the number of cylinders of the internal combustion engine, each of said discharge circuits being connected between the capacitor and the ignition coil for another cylinder, wherein the energy stored in each of said capacitors is discharged through the primary winding of the ignition coil of another cylinder during the conduction of the switching means for said another cylinder.

13. An ignition system according to claim 10 comprising a couple of the second diodes and a couple of the third diodes, said transformer having an end of the primary winding thereof connected through each of said second diodes to an end of each of said primary windings of said ignition coil, said discharge circuit being connected to an end of each of said primary windings of said ignition coil through each of said third diodes.

* * * * *